United States Patent [19]

Hanser

[11] 3,943,637

[45] Mar. 16, 1976

[54] APPARATUS FOR TREATING PARTICULATE MATERIAL

[75] Inventor: Paul Edmond Hanser, Moline, Ill.

[73] Assignee: HWH Corporation, Rock Island, Ill.

[22] Filed: Jan. 6, 1975

[21] Appl. No.: 538,529

[52] U.S. Cl. ..... 34/56; 34/132; 34/137; 214/18 K

[51] Int. Cl.[2] ..... F26B 13/10

[58] Field of Search ..... 34/130, 132, 137, 141, 34/142, 56, 133; 214/18 RK; 432/108, 117; 259/3, 30

[56] References Cited

UNITED STATES PATENTS

| | | | |
|---|---|---|---|
| 661,847 | 11/1900 | Burns | 259/3 |
| 2,354,567 | 7/1944 | Adt | 34/137 |
| 2,492,792 | 12/1949 | Ford | 432/117 |
| 2,513,413 | 7/1950 | Huszar | 259/3 |
| 2,994,912 | 8/1961 | Eades | 259/30 |
| 3,054,663 | 9/1962 | Komline | 259/30 |
| 3,245,759 | 4/1966 | Eweson | 34/137 |
| 3,849,903 | 11/1974 | McGehee | 34/56 |

*Primary Examiner*—Carroll B. Dority, Jr.
*Assistant Examiner*—Larry I. Schwartz
*Attorney, Agent, or Firm*—Thomas E. Frantz

[57] ABSTRACT

A readily portable apparatus for roasting, drying or otherwise treating grain or other similar particulate material on a continuous fully controlled basis. The material is metered into one end of a revolving drum containing structure for cascading the material through a high temperature gas stream generated by a heating device carried at the other end of the drum. The material gradually traverses the length of the drum while being subjected to such cascading and heating, and is then extracted or discharged out of the other end of the drum. The drum may be tilted a few degrees from the horizontal to provide precise control of the rate and time of traverse of the material through the drum.

For purposes of quick and convenient access to the interior of the drum, the heating and material extracting devices are mounted on a hinged cover at the discharge end of the drum.

15 Claims, 6 Drawing Figures

APPARATUS FOR TREATING PARTICULATE MATERIAL

BACKGROUND OF THE INVENTION

1. Field of the Invention

The present invention relates generally to apparatus for treating grain and the like, and more particularly to a portable apparatus having a rotating drum through which grain or other similar particulate material is fed while being subjected simultaneously to heat and agitation.

2. Description of the Prior Art

Corn, oats, rye, barley, milo and other small grains comprise a significant constituent of the usual fodder employed in feeding farm animals. Although vast quantities of grains are grown for feeding purposes, present day costs make it highly desirable that grains be utilized as efficiently as possible by animals in terms of energy, growth and health.

In the past, it has been the general practice to feed dried grain, in some cases the grain being ground into relatively small particles or pieces before being used.

It has been found, however, that roasted grain — whether or not ground — is substantially more digestible and nutritious to farm animals than dried grain. Thus, use of roasted rather than dried grain in fodder will lower the cost of raising farm animals, and such reduced costs ultimately should result in lower meat prices at the retail level.

Most farm operators, however, continue to use dried grain because of the lack of reliable, reasonably priced, readily available and conveniently operated equipment for roasting grain on a volume basis.

Also, in the past, seed companies have been faced with the problem of disposing of large quantities of coated or "treated" seed grain which is found to be surplus at the end of a planting season. Such seed grain neither should be held until the following year because of loss in germination quality nor be fed to farm animals as the "treatment" coating or captan usually includes potentially injurious materials such as insecticides, rodent repellents, fungus retardents, growth stimulants, and the like. It has been found that enough of the captan can be broken down and/or removed to render seed grain acceptable for feeding purposes, however, if the seed is tumbled vigorously while simultaneously being subjected to a flow of high temperature gases.

SUMMARY OF THE INVENTION

It is a principal object of this invention to provide a novel apparatus for treating grains and other similar particulate materials.

Another object of this invention is the provision of a readily portable grain treating apparatus which is relatively inexpensive yet reliable and conveniently operated.

Yet a further object of this invention is to provide a grain treating apparatus having a revolving drum and means for controlling the quantity at which grain is fed into and extracted from the drum and the rate of movement of the grain through the drum.

Still another object of the invention is the provision of a novel apparatus adapted for a wide variety of uses in roasting grain, removing and/or breaking down captan, drying grain and other heating processes involving tumbling of particles in the presence of a high temperature gas stream.

These and other objects of the present invention will become [illegible]n more apparent from the following description taken in conjunction with the accompanying drawings which illustrate a preferred embodiment thereof.

The present invention provides an improved and novel apparatus for treating particulate material including an elongate cylindrical drum rotatably supported in a generally horizontal position by a frame having a pair of wheels to permit convenient movement of the assembly. A hopper is mounted on the frame proximate one end of the drum, with a feeding device being provided for moving a predetermined controlled amount of material from the hopper into the drum during rotation thereof. Within the drum is a series of longitudinal ribs which cascade the material through the center portion of the drum, there being a heating device opening through the other end of the drum and expressing a heated stream of gas thereinto for heating the particulate material as it is cascaded along the length of the drum. The heating device is mounted on a closure or door pivoted on the frame. There is also a manually movable diverter carried by the closure for selective projection into the drum to divert a portion of the cascading material into a discharge port for discharge from the apparatus.

The heated gas stream is vented to the atmosphere through a stack provided between the drum and hopper, a fan assembly being located in the stack for rotation with the drum.

BRIEF DESCRIPTION OF THE DRAWINGS

In the drawings:

Referring now to FIG. 1, there is disclosed a roasting or drying apparatus 10 which includes a cylindrical drum or chamber 12 rotatably supported in a generally horizontal position on a rigid frame 14 by two pair of rollers 16. As will be apparent from FIGS. 3 and 4, the rollers 16 are journaled on brackets 18 which are rigidly affixed to frame 14, one pair of rollers 16 being disposed adjacent each end of the drum 12.

Figure 1:
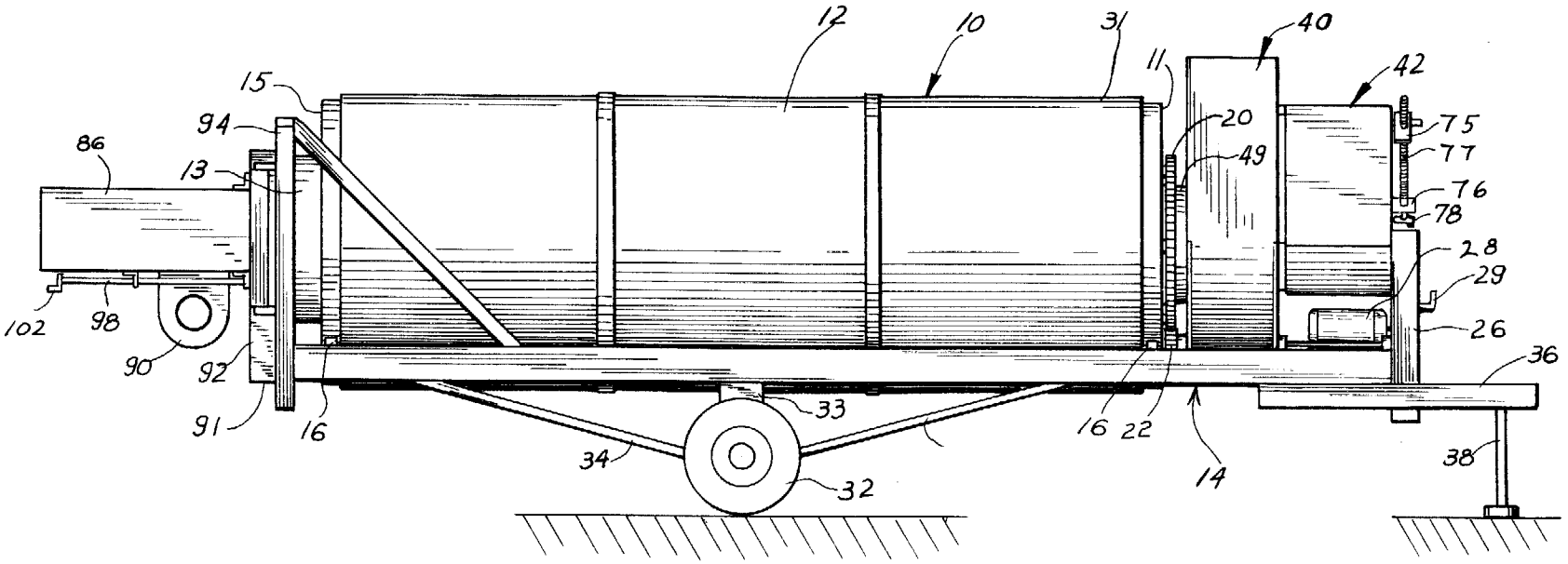
FIG. 1 is a side elevational view of an apparatus embodying this invention.

Rotation of drum 12 on rollers 16 may be effected by any one of a number of means, as by a chain or belt drive, gears, etc. In the present embodiment, however, there is shown a large diameter gear 20 fixed to the forward end of the drum 12, gear 20 meshing with a smaller drive gear 22 which is mounted on a rotatable shaft 24. Shaft 24 is driven within transmission box 26 which, in turn, is operatively engaged with a conventional power source such as an electric motor 28 carried on the forward end of the frame 14.

To avoid unnecessary complications in the drawings, neither the power transmission means between motor 28 and transmission box 26 nor the power train within box 26 are shown. Such elements are old and well known and would be readily understood by anyone skilled in the art. It might be pointed out, however, that handle 29 is shown as representing a manually operable lever for engaging and disengaging the power train during operation of apparatus 10.

As will be understood from the following description, drum 12 is heated to a relatively high temperature during use. To prevent excess heat loss, there is provided an insulative covering 30 and outer jacket 31 which surround the cylindrical portion of drum 12 except at its extreme ends. The ends of the drum 12, of course, are left exposed to form "tracks" on which rollers 16 revolve as the drum rotates during use.

Support means consisting of wheels 32, brackets 33 and brace members 34 are provided on frame 14 to permit convenient movement of the apparatus 10. Extending forwardly of the frame 14 is a tongue member 36 which is adapted to be attached to a tow truck or vehicle for convenient movement of the apparatus 10. Adjacent the forward end of the tongue 36, there is provided a downwardly depending support leg 38. For reasons which will be apparent from the following description, the support leg 38 should be extendable and retractable within predetermined limits to permit raising and lowering of the forward end of the apparatus 10.

Figure 4:
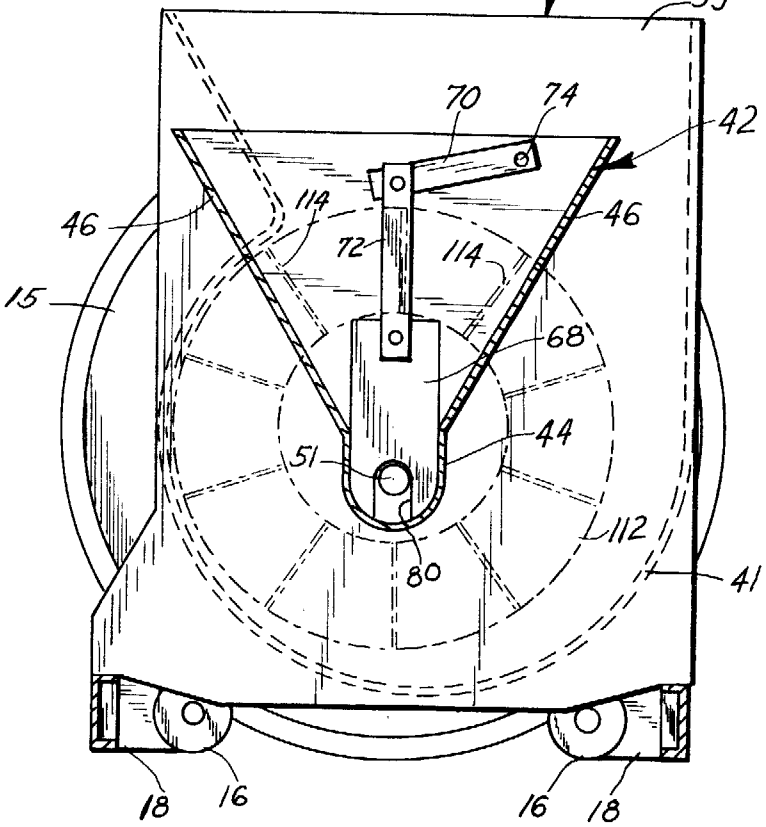
FIG. 4 is a cross sectional view taken on the line 4—4 in FIG. 2.

Disposed on the frame 14 forwardly of the drum 12 is a vent stack 40, comprising substantially planar inner and outer wall portions 37 and 39 and a connecting wall member 41, the top of which is open to the atmosphere to permit dissipation of heated air from the interior of drum 12. Positioned forwardly of the stack 40 is a hopper 42 which, as best illustrated in FIG. 4, includes a semi-circular lower trough portion 44 and outwardly flaring sides 46. The top of the hopper 42, of course, is open for the reception of grain or other particulate material to be treated by the apparatus 10.

Figure 2:
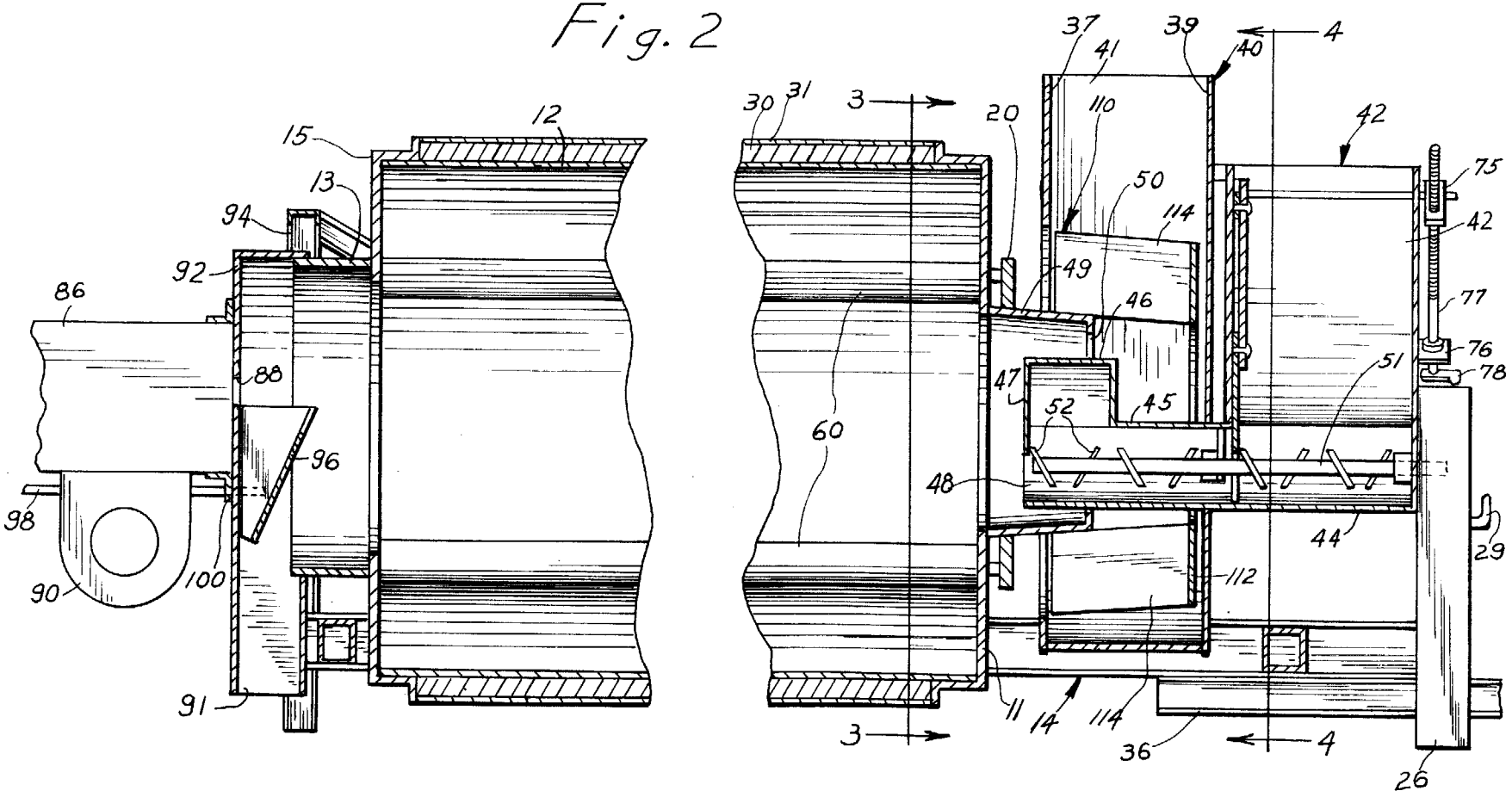
FIG. 2 is a fragmentary longitudinal sectional view of the embodiment of FIG. 1 wherein the diverter is shown in a retracted or inoperative position.

As will be seen best from FIG. 2, an elongate semi-circular trough portion 44 of hopper 42 extends through the stack 40 and into a frusti-conical collar 49. Disposed over and closing the trough 44 externally of hopper 42 is a cover member 45 terminating in an upwardly projecting gabled portion 46 having a closed inner end 47 through which extends an opening 48. The larger end of this collar 49 is fixed, as by welding, to the end 11 of drum 12, and is rotatable therewith. The smaller end of the collar 49 extends into stack 40 through a suitably sized aperture in the inner wall thereof. Formed in the outer end of collar 49 is an inlet or inlet port 50.

A rotatable member 51 is rotatably housed in the semi-circular trough 44, and provided along its length with a plurality of helix surfaces 52. The member 51 is coextensive with the trough 44, extending from the forward end of the hopper 42 into the collar 49. Rotation of the member 51 is effected by a suitable drive (not shown) in transmission box 26 which is actuated simultaneously with rotation of the drum 12.

Grain or other particulate material to be treated by the apparatus 10 is poured into hopper 42 through its open upper end, the material being picked up by the member 51 and moved forwardly along trough 44 until it is expelled into the collar 49 through opening 48. Because of the tapering configuration of collar 49, movement of the grain will continue into the interior of drum 12.

Should the present apparatus 10 be used with a grain conveyor for filling the hopper 42, it is recommended that a level control be used in the hopper to provide automatic control of the conveyor and of the amount of grain entering the hopper.

Figure 3:
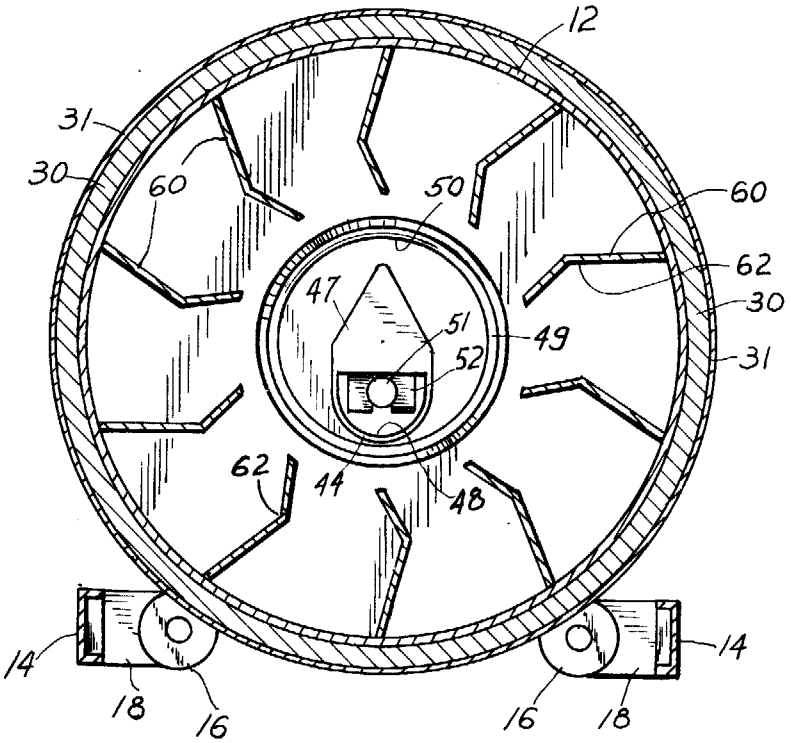
FIG. 3 is a cross sectional view taken on the line 3—3 in FIG. 2.

Vigorous agitation, tumbling and cascading of the grain or other particulate material being treated by the apparatus 10 is effected by a series of ribs 60 which extend the length of the drum 12 and which, as best shown in FIG. 3 project generally radially from the interior wall of the drum to a point approximately midway toward the center thereof to define an unobstructed central core portion which extends the length of drum 12. Further, it will be noted that ribs 60 are evenly spaced around the interior periphery of the drum. To assure that the grain is elevated to a substantial height in drum 12 before being dropped from ribs 60, the ribs are formed with angular offsets or pockets 62 which face in the direction of rotation of drum 12. Thus, grain in the bottom of the drum is picked up and held in the pockets of ribs 60 until approaching the top of the drum. Accordingly, grain rolling from ribs 60 will be assured of cascading or dropping a substantial distance before hitting the bottom of the drum or being picked up by another rib.

In use, the rearward end of the apparatus 10 is tilted slightly downwardly, the front end being elevated by support leg 38 until the drum 12 is positioned at an approximate 3° angle with respect to the horizontal. It is understood, of course, that this angle may be varied readily to effect either faster or slower feeding of particulate material the length of the drum. However, as mentioned above, an approximate 3° tilt has been found satisfactory for most purposes.

A mechanism is provided in the hoppper 42 to control the quantity of grain fed by the member 51 from the hopper 42 into the drum 12. This device, best shown in FIG. 4, comprises a gate member 68 adapted to be selectively raised and lowered by an arm 70 and link 72, the arm 70 being fixed to and rotatable with shaft 74. Limited rotation of shaft 74 is effected by lever 75 (See FIGS. 1 and 2) which is operatively engaged with a fixed member 76 by a threaded rod 77. The lower end of threaded rod 77 carries a handle 78. Thus, manual rotation of handle 78 rotates threaded rod 77 which in turn rotates lever 75 and shaft 74 to raise or lower the gate 68. In this connection, the gate member 68 includes a slot 80 which straddles the member 51, the amount of grain being moved forwardly by the member depending upon the height to which the gate member 68 is raised. As illustrated in FIG. 4, the gate member is in its extreme downward position, thereby restricting the movement of grain to a minimum. Raising the gate member 68 would permit a greater quantity of grain to be fed from the hopper 42 into the drum 12.

At the rearward end of the drum 12, there is provided a heat generator or furnace 86 which is adapted to burn natural or manufactured gas. A blower 90 forces the flame from furnace 86 through nozzle 88 a substantial distance into the drum 12 so that grain being cascaded therein falls through the flame approximately the last third of its travel.

Figure 6:
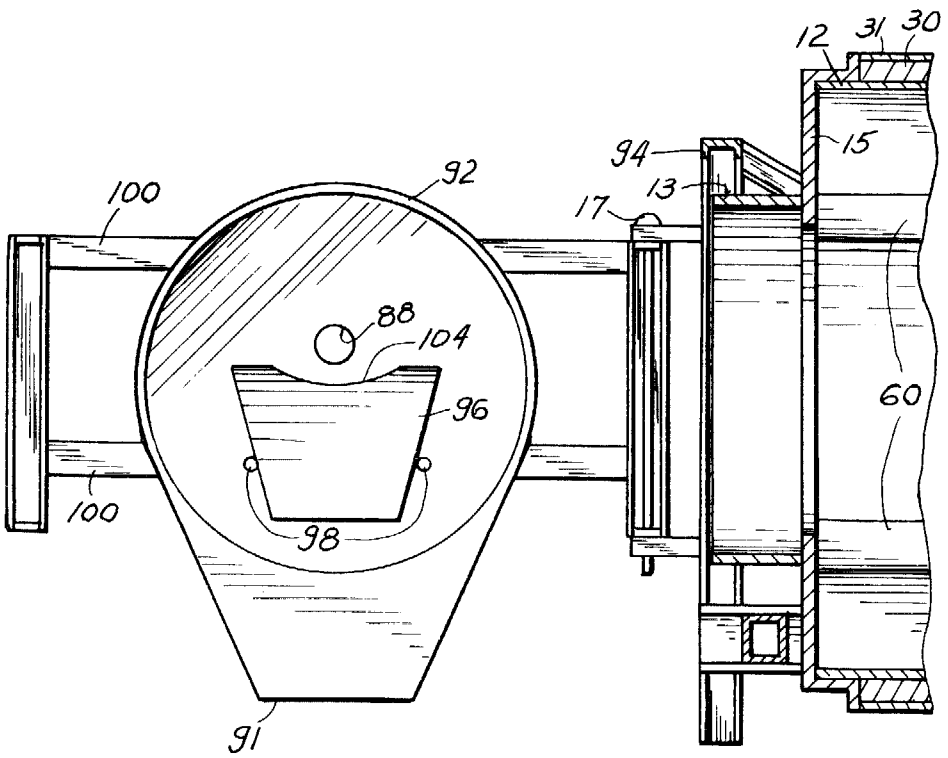
FIG. 6 is a fragmentary longitudinal sectional view similar to that of FIG. 2 except the closure is in an open position.

Furnace 86 is mounted on a hinged door or closure 92 which, as best seen in FIG. 6, swings away from the substantially cylindrical collar 13 which is welded or otherwise affixed to the other end 15 of drum 12. Thus, ready access can be gained to the interior of drum 12 for cleaning or other purposes. Vertical supports 94 are fixed to frame 14 for purposes of hinging the door 92 on one side and locking it on the other by suitable pins 17.

Figure 5:
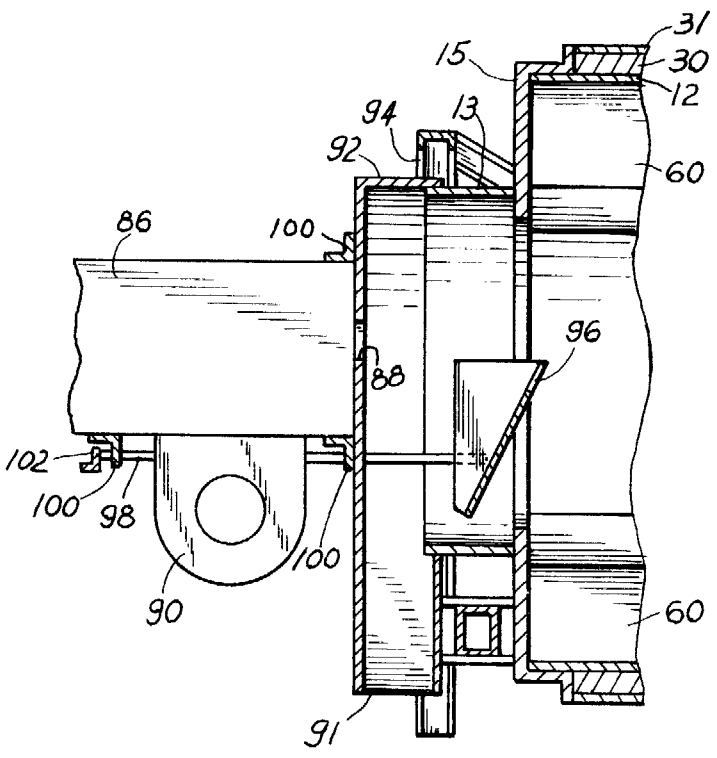
FIG. 5 is a fragmentary longitudinal sectional view similar to that of FIG. 2, except the diverter is shown in an extended operative position.

Mounted on closure 92 is an intercepting means or diverter 96 which, as best seen from FIGS. 2 and 5, is projectable and retractable between an operative position extending into the drum 12 and an inoperative position disposed externally thereof. When projected into drum 12 as illustrated in FIG. 5, the diverter 96 will pick up grain as it is cascaded through the air proximate the rearward end 15 of drum 12, and divert such grain down through the lower open discharge port 91 of the closure 92 into a box or other container provided for receiving the treated grain.

The diverter 96 is mounted on a pair of parallel spaced shaft members 98 which extend through and are slidably supported by two angle iron brackets 100. The rearward end of the shafts 98 are connected by a handle portion 102 which is used manually to project or retract the diverter 96. Thus, if it is desired to leave a charge of grain or other material in the drum 12 for extended treatment, the diverter 96 is pulled rearwardly to the inoperative retracted position illustrated in FIG. 2, and the grain, of course, then stays in the drum for treatment. Extraction of grain is then effected by projecting the diverter 96 into the drum 12 to divert grain through the discharge 91 as it drops from ribs 60 adjacent the rearward end of the drum.

As best shown in FIGS. 2, 5 and 6, the diverter 96 includes a tapered forward wall and tapered side edges, the forward wall including a semi-spherical cut out portion 104 to permit the flame from nozzle 88 to flow readily into the drum 12.

In using the present embodiment, it has been found that rotation of the drum at approximately 10 rpm, with a 3° tilt, will permit treatment of approximately 200 bushel of corn per hour. The temperature of the flame at the nozzle of the furnace preferably is in the neighborhood of 1000°–1500° F, with the temperature dropping at the vent stack 40° to about 250° F.

Referring particularly to FIGS. 2 and 4, there is mounted on collar 49 within vent stack 40 a fan assembly 110 which rotates with drum 12 and collar 49. The fan assembly 110 includes an outer annular plate 112 and a plurality of radially disposed blades 114 affixed to the plate 112 and the collar 49. As illustrated by the dotted lines in FIG. 4, the connecting wall member 41 is curved around the fan assembly 114 and forms therewith a "squirrel cage" type blower for pulling heated air from the drum 12 and blowing said air upwardly.

Should the drum 12 measure approximately 12' long by 4' in diameter, a furnace having a capacity of about 1,500,000 BTU per hour has been found desirable.

At an approximate 3° tilt, it has been found that grain remains in the drum for approximately 3 to 4 minutes; that is, it takes approximately 3 to 4 minutes for grain entering the drum from the member 51 to traverse the length thereof and be extracted by the diverter 96. Also, as will be apparent from the above description, for approximately the last 4 to 5 feet in the drum, the grain falls through the flame from the furnace 86.

Obviously, many modifications and variations of the invention are possible in light of the teachings in this application. It is to be understood, therefore, that the foregoing is neither desired nor intended to limit the invention.

What is claimed is:

1. An apparatus for treating particulate material, comprising

A. an elongate generally cylindrical drum having an inlet at one end and an outlet at the other end, B. means supporting said drum in a generally horizontal position for rotation around its longitudinal axis, C. means for selectively rotating said drum, D. means for receiving a supply of particulate material to be treated, E. means for feeding a selectively variable quantity of material from said supply means through said inlet into said drum during rotation thereof, F. means operable upon rotation of said drum for cascading material received therein generally transversely through the central core portion thereof while permitting longitudinal movement of said material toward said outlet, G. a closure supported proximate the other end of said drum substantially surrounding said outlet, H. said closure having a discharge port communicating with said outlet, I. means for expressing a heated gas stream through said outlet into said central core portion of said drum, J. means for venting said gas stream through said inlet after said stream has traversed the length of said drum through said cascading material, and K. means for removal of treated material from said apparatus, said means comprising i. a diverter movable from an inoperative position spaced from said cascading material to an operative position projecting into the path of and intercepting material cascading within said drum proximate said outlet and diverting said intercepted material through said outlet into said discharge port for discharge from said apparatus, and ii. means for moving said diverter between said positions and for selectively varying said projection of said diverter when in said operative position to control the quantity of material removed from said drum.

2. An apparatus according to claim 1, wherein said vent means includes a fan assembly rotatable with said drum and disposed proximate to and in communication with said inlet.

3. An apparatus according to claim 1, wherein said removal means is supported by said closure for axial movement relative to said drum, said diverter projecting through said outlet when in said operative position.

4. An apparatus according to claim 1, wherein the quantity of material fed by said feeding means into said drum is substantially equal to the quantity of material removed from said drum by said diverter for discharge from said apparatus.

5. An apparatus according to claim 1, characterized by means for tilting said support means and drum to control the rate of movement of said material longitudinally through said drum.

6. An apparatus according to claim 3, characterized by

A. means pivoting said closure on said support means for permitting pivotal movement of said closure to an open position spaced from and exposing said outlet, and B. said heating means being mounted on and movable with said closure.

7. An apparatus according to claim 2, characterized by

A. a tapered collar having its larger end mounted on said one end of said drum around a central aperture in said one end, said collar i. being concentric with said one end, and ii. terminating in an apertured outer end defining said inlet, B. said vent means comprising i. substantially planar inner and outer wall portions mounted in a generally parallel relationship on said support means, ii. a connecting wall member between said inner and outer wall portions and forming therewith a vent stack having an open upper end, iii. said inner wall including an aperture through which the outer end of said tapered collar extends, and iv. said fan assembly being disposed within said vent stack on the outer end of said tapered collar, v. said fan assembly being rotatable with said collar to draw heated gas from said drum through said inlet and force said heated gas through the upper open end of said stack.

8. An apparatus according to claim 1, characterized by

A. a substantially cylindrical collar mounted on said other end of said drum around a central aperture therein, said cylindrical collar i. being concentric with said other end, and ii. terminating in an apertured outer end defining said outlet, B. said closure comprising i. a substantially planar outer wall, ii. a transverse wall connected to the outer wall and having a curved upper portion sized to receive the upper portion of said cylindrical collar, and iii. an inner wall connected at its edges to the lower portion of said transverse wall and defining a curved edge adapted to receive the lower portion of said cylindrical collar, iv. said outer, inner and transverse walls cooperating to define a downwardly opening discharge port communicating with said outlet when said closure is in a closed position substantially surrounding said outlet, and C. said heating means being mounted on said outer wall of said closure and expressing said heated gas stream through an orifice in said wall.

9. An apparatus according to claim 1, wherein

A. said diverter comprises a scoop shaped member i. sized to enter said drum through said outlet, ii. open at its top, bottom and back, and iii. provided with a rearwardly angled transverse face plate and inwardly angled side plates, B. said moving means comprises a pair of shaft members connected to said side plates and extending outwardly therefrom through said closure, and C. means connecting said shafts externally of said closure and providing a handle for the manual movement of said diverter between said inoperative and operative positions.

10. An apparatus according to claim 1, wherein said support means comprises A. an enlongate substantially rigid frame disposed generally parallel with the longitudinal axis of said drum, B. a plurality of rollers journaled at spaced locations on said frame for rotatably engaging said drum, and C. a plurality of support members depending from and supporting said frame in a spaced relation with the ground, D. one of said support members being variable in length and constituting said tilting means.

11. An apparatus according to claim 10, wherein at least two of said support members are provided with rotatable wheel assemblies engaging the ground to permit movement of said apparatus over said ground.

12. An apparatus according to claim 11, wherein

A. said material supply means comprises a hopper having an open upper end and has a closed lower end, B. said feeding means includes i. a generally semi-circular trough portion extending from within said hopper through said vent stack and into said inlet, ii. a rotatable member within and generally coextensive with said trough, iii. helix surface means provided on said rotatable member and operable upon rotation of said member to convey material from said hopper into said drum.

13. An apparatus according to claim 12, characterized by metering means providing said selective variation in the quantity of material fed by said feeding means, said metering means comprising A. a gate member i. provided with a centrally disposed slot sized to straddle said rotatable member between portions of said helix surface means, and ii. a shaped lower surface adapted to substantially conform to the cross sectional configuration of said trough, and B. manually accessible means for vertically moving said gate member between a lower position substantially blocking said trough and an upward position providing a desired feed of material from said hopper into said drum.

14. An apparatus according to claim 10, characterized by

A. an annular track formed proximate each end of said drum for engagement with said rollers, and B. a covering of insulative material surrounding substantially all of the cylindrical wall of said drum except said annular tracks.

15. An apparatus according to claim 1, wherein said cascading means comprises a plurality of longitudinally disposed ribs spaced relatively evenly around the interior wall of said drum, said ribs A. extending substantially the full length of said drum, B. projecting generally radially from said interior wall toward the center of said drum, C. terminating intermediate said inner wall and the center of said drum to provide said central core portion extending the length of said drum, and D. including in cross section an angularly offset pocket adapted to receive material therein, to elevate said material to a substantial height in said drum, and to release said material for said cascading action.

* * * * *